US012129603B2

(12) United States Patent
Zhang et al.

(10) Patent No.: US 12,129,603 B2
(45) Date of Patent: Oct. 29, 2024

(54) GROUND RAIL TRANSFER DEVICE AND GAUGE CHANGING SYSTEM

(71) Applicant: CRRC TANGSHAN CO., LTD., Hebei (CN)

(72) Inventors: Xiaojun Zhang, Tangshan (CN); Jianke Zheng, Tangshan (CN); Lijun Zhang, Tangshan (CN); Hongjiang Xu, Tangshan (CN); Xiuyu Sun, Tangshan (CN); Feng Zhao, Tangshan (CN); Yongjiang Ma, Tangshan (CN); Xueyi Song, Tangshan (CN); Guangsheng Zheng, Tangshan (CN); Taoguang Hao, Tangshan (CN); Wei Wang, Tangshan (CN)

(73) Assignee: CRRC TANGSHAN CO., LTD., Hebei (CN)

( * ) Notice: Subject to any disclaimer, the term of this patent is extended or adjusted under 35 U.S.C. 154(b) by 902 days.

(21) Appl. No.: 17/273,694

(22) PCT Filed: Sep. 7, 2018

(86) PCT No.: PCT/CN2018/104644
§ 371 (c)(1),
(2) Date: Mar. 4, 2021

(87) PCT Pub. No.: WO2020/047852
PCT Pub. Date: Mar. 12, 2020

(65) Prior Publication Data

US 2021/0395952 A1 Dec. 23, 2021

(30) Foreign Application Priority Data

Sep. 5, 2018 (CN) ..... 201811030486.8

(51) Int. Cl.
*E01B 26/00* (2006.01)
*B61F 5/52* (2006.01)
(Continued)

(52) U.S. Cl.
CPC ..... *E01B 26/00* (2013.01); *B61F 5/52* (2013.01); *B61F 7/00* (2013.01); *B61L 3/00* (2013.01); *B61K 13/00* (2013.01)

(58) Field of Classification Search
CPC . B61F 7/00; E01B 26/00; B61K 13/00; B61L 3/00; B61L 11/02
(Continued)

(56) References Cited

U.S. PATENT DOCUMENTS 5,471,933 A * 12/1995 Yoshino ..... B61H 9/00 105/178
8,590,459 B2 11/2013 Forclaz
(Continued)

FOREIGN PATENT DOCUMENTS

CN 1143584 A 2/1997
CN 1232105 A 10/1999
(Continued)

OTHER PUBLICATIONS

International Search Report in the international application No. PCT/CN2018/104644, mailed on Dec. 6, 2018.
(Continued)

*Primary Examiner* — Zachary L Kuhfuss
*Assistant Examiner* — Heaven R Buffington
(74) *Attorney, Agent, or Firm* — Syncoda LLC; Feng Ma

(57) ABSTRACT

A ground rail transfer device includes: a support rail provided on the ground and used for unloading a vertical load of a bogie in a rail vehicle; a guide rail provided on the ground and used for driving the bogie to perform a rail transfer operation; and a transition plate provided on the
(Continued)

ground and located between a first rail and a second rail which are different in a gauge; wherein a difference between the top surface height of the transition plate and the top surface height of the first rail is equal to a distance between a wheel rim vertex circle and a wheel tread of the rail vehicle.

17 Claims, 21 Drawing Sheets

(51) Int. Cl.
*B61F 7/00* (2006.01)
*B61L 3/00* (2006.01)
*B61K 13/00* (2006.01)

(58) Field of Classification Search
USPC ..... 104/33
See application file for complete search history.

(56) References Cited

U.S. PATENT DOCUMENTS

| | | | |
|---|---|---|---|
| 2010/0319564 | A1 | 12/2010 | Forclaz |
| 2011/0265682 | A1 | 11/2011 | Lopez Gomez |

FOREIGN PATENT DOCUMENTS

| | | | |
|---|---|---|---|
| CN | 200992209 | Y | 12/2007 |
| CN | 102076544 | A | 5/2011 |
| CN | 207159720 | U | 3/2018 |
| CN | 108407840 | A | 8/2018 |
| EP | 0611847 | A1 | 8/1994 |
| EP | 0747278 | A1 | 12/1996 |
| EP | 0942100 | A2 | 9/1999 |
| EP | 1339918 | A1 | 9/2003 |
| FR | 2617146 | A1 | 12/1988 |
| JP | H06298090 | A | 10/1994 |
| WO | 9936627 | A1 | 7/1999 |
| WO | 2009106988 | A2 | 9/2009 |

OTHER PUBLICATIONS

English translation of the Written Opinion of the International Search Authority in the international application No. PCT/CN2018/104644, mailed on Dec. 6, 2018.

Shao Yatang et al. "Scheme Design of Ground Transformation Facility for Gauge-changeable Trains" Electric Drive for Locomotives No. 4, 2018 (Jul. 10, 2018).

Supplementary European Search Report in the European application No. 18932362.9, mailed on Oct. 4, 2021.

* cited by examiner

GROUND RAIL TRANSFER DEVICE AND GAUGE CHANGING SYSTEM

CROSS-REFERENCE TO RELATED APPLICATIONS

The present application is a national stage of International Application No. PCT/CN2018/104644 filed on Sep. 7, 2018, which claims priority to Chinese Patent Application No. 201811030486.8, filed on Sep. 5, 2018. The disclosures of these applications are hereby incorporated by reference in their entirety.

TECHNICAL FIELD

The disclosure relates to a railway vehicle gauge changing technology, and particularly to a ground railway transfer device and a gauge changing system.

BACKGROUND

A railway vehicle is usually divided into a monorail train and a double rail train. Among them, the double rail train runs along two rails having a same gauge therebetween. The gauge is a distance between two rails. Most countries or regions adopt a uniform gauge, but the gauge adopted by some countries or regions is different. The railway train needs to transfer railway before the railway train moves from a railway having one gauge to a railway having another gauge, that is, to adjust a distance between two wheels connected on the same axle in a railway train so that the distance between the wheels can adapt to a new gauge.

In related railway transfer technology, a ground railway transfer device is usually arranged between a wide gauge railway and a narrow gauge railway. The ground railway transfer device is configured for unloading a vertical load of a bogie of a railway vehicle, and applies a railway transfer driving force onto the bogie to change the distance between two wheels connected on the same axle. The wheels will fall down and roll on the ground after the wheels of the bogie leave the wide gauge (narrow gauge) railway. When the wheels reach the narrow gauge (wide gauge) railway, the wheels move up to the narrow gauge (wide gauge) railway to complete the railway transfer operation, by the vertical component of the traction force.

At the moment the wheels fall down, a greater vibration will be produced, which will have a certain impact on the service life of the components in the bogie. In addition, returning the wheels to the railway requires greater traction force and consumes higher kinetic energy.

SUMMARY

The embodiments of the disclosure provide a ground railway transfer device and a gauge changing system, which can reduce energy consumption and reduce the vibration amplitude of the bogie.

An embodiment of a first aspect of the disclosure provides a ground railway transfer device for driving a railway vehicle to switch between a first railway and a second railway, the first railway has a gauge called as a first gauge, the second railway has a gauge called as a second gauge, the first gauge being different from the second gauge; in which the ground railway transfer device includes:

a support rail arranged on the ground and configured for unloading a vertical load of a bogie in the railway vehicle;

a guide rail arranged on the ground and configured for driving the bogie to perform a railway transfer operation;

a transition plate arranged on the ground and located between the first railway and the second railway, a difference in a height direction between a top surface of the transition plate and a top surface of the first railway being equal to a distance between a wheel rim tip circle and a wheel tread of the railway vehicle.

An embodiment of a second aspect of the disclosure provides a gauge changing system including: a gauge changing bogie and the above-mentioned ground railway transfer device.

The technical solution provided by embodiments of the disclosure uses the support rail arranged on the ground to unload the vertical load of the bogie in the railway vehicle, and uses the guide rail arranged on the ground to drive the bogie to perform the railway transfer operation, so that the bogie can switch between the first gauge and the second gauge. The technical solution also uses the transition plate arranged on the ground and located between the first railway and the second railway. The difference in a height direction between the top surface of the transition plate and the top surface of the first railway is equal to the distance between the wheel rim tip circle and the wheel tread of the railway vehicle. The transition plate is configured for supporting wheels after the wheels leave the first railway or the second railway, in which heights of the wheels do not change, so that the wheels will not fall down and thus large vibration can be avoided.

BRIEF DESCRIPTION OF THE DRAWINGS

The present disclosure will become more fully understood from the accompanying drawings, which constitute a part of the disclosure. The illustrative embodiments of the disclosure and the description thereof are used to explain the disclosure, and do not constitute an improper limitation of the present disclosure. In the accompanying drawings.

Figure 1:
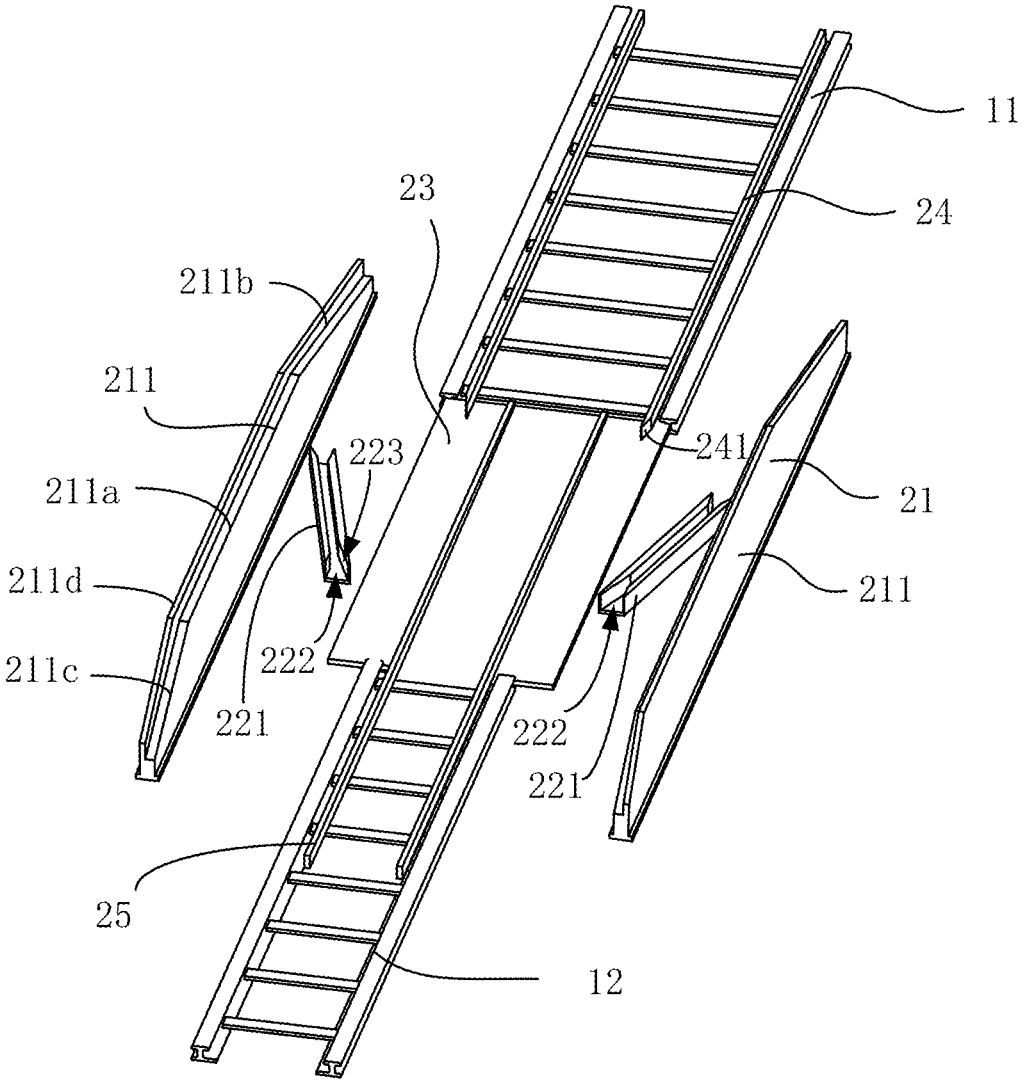
FIG. 1 is a schematic view of a structure of a ground railway transfer device provided by a first embodiment of the disclosure.

Reference numerals are listed as follows.

11: first railway; 12: second railway;

21: support rail; 211: support body; 211*a*: support plane; 211*b*: first support slope; 211*c*: second support slope; 211*d*: block portion; 22: guide rail; 221: guide body; 222: guide groove; 23: transition plate; 24: first guide member; 241: first guide slope; 25: second guide member;

31: half-frame; 311: motor hanger; 32: bolster; 33: railway transfer support member; 331: driving member; 3311: cylinder; 3312: piston rod; 3313: slider; 332: driven member; 3321: roller; 3322: sliding groove; 34: wheel; 35: traction motor; 36: rail transfer guide member; 371: first insertable connector; 372: second insertable connector.

DETAILED DESCRIPTION

In order to make the technical solutions and advantages of the embodiments of the disclosure clearer, the exemplary embodiments of the disclosure will be further described in detail below with reference to the accompanying drawings. Apparently, the described embodiments are only a part of the embodiments of the disclosure, rather than an exhaustive list of all the embodiments. It should be noted that the embodiments in the disclosure and the features in the embodiments can be combined with each other in the case of no conflict.

First Embodiment

The embodiment of the disclosure provides a ground railway transfer device, which can drive a bogie to perform a railway transfer operation during traveling of a railway vehicle, so as to adapt to different gauges.

FIG. 1 is a schematic view of a structure of the ground railway transfer device provided by the first embodiment of the disclosure. As shown in FIG. 1, the embodiment provides a ground railway transfer device for driving a railway vehicle to switch between a first railway 11 and a second railway 12, the first railway 11 has a gauge called as a first gauge, the second railway 12 has a gauge called as a second gauge, the first gauge is different from the second gauge.

If the first gauge is smaller than the second gauge, the first railway is called a narrow gauge railway, and the second railway is called a wide gauge railway. If the first gauge is greater than the second gauge, the first railway is called a wide gauge railway, and the second railway is called a narrow gauge railway. The ground railway transfer device provided by this embodiment can drive a railway train to perform a railway transfer operation during traveling, so that the train can switch from a narrow gauge railway to a wide gauge railway or from a wide gauge railway to a narrow gauge railway without stopping.

In the embodiment, taking the first gauge being greater than the second gauge as an example, the implementation manner of the ground railway transfer device will be described in detail.

As shown in FIG. 1, the ground railway transfer device includes: a support rail 21, a guide rail 22 and a transition plate 23. The support rail 21 is arranged on the ground and configured for unloading a vertical load of a bogie. The guide rail 22 is arranged on the ground and configured for driving the bogie to perform a railway transfer operation. The transition plate 23 is arranged on the ground and located between the first railway 11 and the second railway 12. A difference in a height direction between a top surface of the transition plate 23 and a top surface of the first rail 11 is equal to a distance between a wheel rim tip circle and a wheel tread of the railway vehicle, so that the transition plate can support wheels after the wheels leave the first railway or the second railway.

The ground railway transfer device provided by the embodiment is a gauge changing bogie capable of changing the distance between the wheels. The bogie can adopt various manners. For example, the bogie can include: two half-frames arranged in parallel and a bolster extending across the two half-frames, in which the two half-frames can move with respect to each other. Two wheel pairs are arranged in parallel between the two half-frames, each wheel pair includes an axle and wheels arranged at both ends of the axle, the wheels move synchronously with the half-frame. A traction structure is provided between the bolster and each of the two half-frames, and the bolster can provide a traction force to the half-frame by the traction structure.

An area between the first railway 11 and the second railway 12 is provided as a railway transfer area, in which the ground railway transfer device is arranged. Each bogie can perform a railway transfer operation when entering the railway transfer area. For example, when the bogie leaves the first railway 11 and enters the railway transfer area, the ground railway transfer device drives the two half-frames to move towards each other to reduce the distance between the two wheels until the gauge corresponding to the second railway 12 is satisfied, after which the bogie can enter the second railway 12.

The support rail 21 is configured for supporting the bolster when the bogie enters the railway transfer area and raising the bolster so that the bolster no longer exerts a vertical pressure on the half-frames, but the traction force remains unchanged.

The guide rail 22 is configured for applying a driving force to the two half-frames to drive the two half-frames move toward each other to reduce the distance between the wheels.

When the railway vehicle travels on the first railway 11, the height of the wheel rim tip circle is the same as the height of the top surface of the transition plate 23. Therefore, the wheel rim contacts the transition plate 23 and thus the wheel will not fall down, when the bogie leaves the first railway 11. In this way, a smooth transition between the first railway 11 and the transition plate 23 is realized, and large vibration produced by the bogie is avoided.

Certainly, for bogie of other structure, the above mentioned support rail 21 and guide rail 22 can be implemented correspondingly to cooperate with the bogie to unload the vertical load, and then push the bogie for railway transfer operation.

The technical solution provided by the embodiment uses the support rail arranged on the ground to unload the vertical load of the bogie in the railway vehicle, and uses the guide rail arranged on the ground to drive the bogie to perform the railway transfer operation, so that the bogie can switch between the first gauge and the second gauge. The technical solution further uses the transition plate arranged on the ground and located between the first railway and the second railway; the difference in a height direction between the top surface of the transition plate and the top surface of the first railway is equal to the distance between the wheel rim tip circle and the wheel tread of the railway vehicle, and therefore the wheels are supported after the wheels leave the first railway or the second railway, in which the heights of the wheels do not change, so that the wheels will not fall down and thereby avoiding large vibration.

Second Embodiment

The embodiment is based on the above mentioned embodiment to optimize the ground railway transfer device.

As shown in FIG. 1, the ground railway transfer device further includes: a first guide member 24 arranged inside the first railway 11 and configured for guiding the wheels traveling to the first railway. The wheels roll on the transition plate 23 after the wheels leave the second railway 12, and due to the loss of the guiding effect of the first railway 12, the wheels are easier to move in a transverse direction. The first guide member 24 can guide the wheels so that the wheels can travel to the first railway 11 accurately.

The first guide member 24 can be implemented in a variety of manners, as long as the wheels can be guided. Specifically, the embodiment is implemented in a way that: the first guide member 24 is parallel to the first railway 11 and is spaced from the first railway 11 by a gap. An end of the first guide member 24 facing toward the second railway 12 protrudes beyond the first railway 11 and a surface of the end facing toward the first railway 11 is provided with a first guide slope 241.

After the bogie has completed the railway transfer operation, the wheels first contact the first guide member 24 during moving forward, and the first guide slope 241 guides the wheels to enter the gap between the first guide member 24 and the first railway 11 so as to reach the first railway 11 more accurately.

Specifically, the first guide member 24 is a structure of long plate shape extending in a longitudinal direction and arranged inside the first railway 11, and the first guide member has an overlapping part that overlaps with the first railway 11 and extends beyond the first railway 11 toward a first end of the second railway 12.

There may be two first guide members 24, symmetrically arranged on the inside of two rails in the first railway 11, and there is a gap between each first guide member and the corresponding rail. The two first guide members 24 respectively guide two wheels, so as to avoid the excessive deviation of the wheels in the transverse direction, which may cause the first railway 11 to not be accurately reached.

The length of the first guide slope 241 along the longitudinal direction can be 200 mm or greater than 200 mm.

Further, a second guide member 25 can also be used. The second guide member 25 can be arranged inside the second railway 12 and configured for guiding the wheels traveling to the second railway 12. The wheels roll on the transition plate 23 after the wheels leave the first railway 11, and due to the loss of the guiding effect of the first railway 11, the wheels are easier to move in the transverse direction. The second guide member 25 can guide the wheels so that the wheels can travel to the second railway 12 accurately.

The second guide member 25 can be implemented in a variety of manners, as long as the wheels can be guided. Specifically, the embodiment is implemented in a way that: the second guide member 25 is arranged inside of the second railway 12, is parallel to the second railway 12 and is spaced from the second railway 12 by a gap. An end of the second guide member 25 facing toward the first railway 11 protrudes beyond the second railway 12. Therefore, after the bogie has completed the railway transfer operation, under the guiding effect of the second guide member 25, the wheels can enter the gap between the second guide member 25 and the second railway 12 so as to reach the second railway 12 accurately.

The second guide member 25 is a structure of long plate shape extending in the longitudinal direction. There may be two second guide members 25, symmetrically arranged inside of the two rails in the second railway 12, and there is a gap between each second guide member and the corresponding rail.

Further, when the second guide member 25 extends to an end of the first railway 11, there is no need to arrange a guide slope on the second guide 25. When wheels are changed from a wide gauge to a narrow gauge, the wheels can directly contact the second guide member 25 and undergo the guiding effect of the second guide member 25.

Third Embodiment

The embodiment is based on the above mentioned embodiment to optimize the ground railway transfer device.

The support rail 21 is configured for, when the bogie enters the rail transfer area, supporting the bolster and raising the bolster so that the bolster no longer exerts vertical pressure on the half-frames, but the traction force remains unchanged. The bolster falls back to the original position, and thus the vertical pressure on the half-frames is restored, when the railway transfer is completed.

The support rail 21 can be implemented in a variety of manners. For example, the following manners provided by the embodiment can be used.

Figure 2:
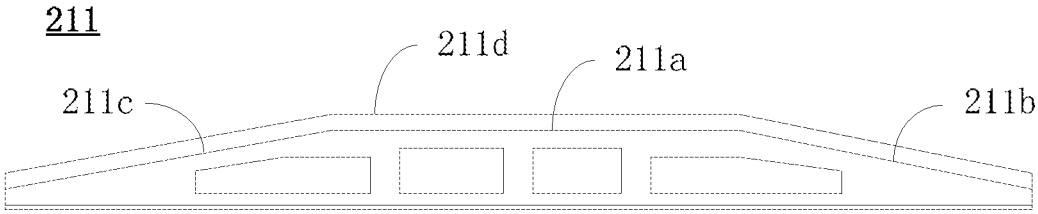
FIG. 2 is a schematic view of a support rail of a ground railway transfer device provided by a third embodiment of the disclosure.

FIG. 2 is schematic view of the support rail of the ground railway transfer device provided by the third embodiment of the disclosure. As shown in FIGS. 1 and 2, the support rail 21 includes: two support bodies 211 with a same structure which are symmetrically distributed on both sides of the transition plate 23. Each of the support bodies 211 is provided with a support structure, for supporting a bolster in the bogie and raising the bolster.

The two support bodies 211 are symmetrically distributed on both sides of the transition plate 23 to support both ends of the bolster, so that both ends of the bolster are raised at the same time, and the raised heights are same.

The support structure can include: a transverse moving member arranged on the support body 211 and a vertical moving member arranged on the support body 211, the transverse moving member can move in the transverse direction, and the vertical moving member is arranged on the transverse moving member, and can move along the transverse direction with the transverse moving member until it moves below the bolster. The vertical moving member can also exert an upward thrust on the bolster. For example: the transverse moving member and the vertical moving member may adopt a hydraulic or pneumatic driver, in which the vertical moving member applies an upward thrust to the bolster to push the bolster to rise. After the railway transfer is completed, the bolster is then driven to fall back to the original position.

Alternatively, the support structure includes: a vertical moving member and a bearing member, in which the bearing member is arranged on the top of the vertical moving member. Correspondingly, both ends of the bolster are provided with a telescopic support part. When the bogie enters the railway transfer area, the support part extends in the transverse direction to above the bearing member, and the vertical moving member drives the bearing member to move upward, thereby exerting an upward thrust on the bolster to push the bolster to rise. After the railway transfer is completed, the bolster is then driven to fall back to the original position.

Alternatively, the following manner can be used. That is, the support structure can be a support plane 211*a* arranged on the top of the support body 211 and support slopes located at both ends of the support plane 211*a*. The support slopes at both ends are called: a first support slope 211*b* and a second support slope 211*c* respectively. The heights of support slopes gradually decrease from the middle of the support body 211 to the both ends of the support body. Correspondingly, telescopic support parts are arranged on the both ends of the bolster. Taking the bolster traveling from the first railway 11 to the second railway 12 as an example, the support part extends in the transverse direction to engage with the second support slope 211*c* when the bogie enters the railway transfer area. As the bogie continues to travel forward, the support part moves forward and upward along the support slope 211*b*, and the bolster is raised accordingly. When the support part reaches the support plane 211*a*, the loads of the bolster and the half-frames are completely unloaded, and then the guide rail 22 can apply a transverse thrust to the half-frames to allow the two half-frames to move toward each other. When the support part moves to the second support slope 211*c* at the other end, the support part moves forward and downward along the second support slope 211*c*, and the bolster falls accordingly.

Further, the length of the support plane 211*a* in the longitudinal direction is designed to be greater than the length of the transition plate 23. The support plane 211*a* has, at one end, an overlapping part that overlaps with the first railway 11, and has, at another end, an overlapping part that overlaps with the second railway 12. In other words, the entire first support slopes 211*b* are located on the both sides of the first railway 11, and the entire second support slopes 211*c* are located on the both sides of the second railway 12. In this way, the bolster can be raised by the support rail 21 to unload the vertical load, before the front wheels in the traveling direction of the bogie start to perform the railway transfer.

In addition, a roller can be arranged on the support part at each of both ends of the bolster, so that there is a rolling friction between the support part and the support body 211. In this way, on the one hand, the degree of wear on the support part and the support body 211 can be reduced, and on the other hand, the friction between the support portion and the support body 211 can be reduced, and thus unnecessary energy consumption can be reduced.

Further, a block portion 211*d* can be arranged on the top of the support body 211. Specifically, the block portion 211*d* can be a structure protruding from the top surface of the support body 211 and arranged on a side of the support body away from the transition plate 23. The block portion 211*d* can prevent the roller from falling from the outside of the support body 211 when the roller of the support part rolls on the top surface of the support body 211.

The block portion 211*d* can be arranged on the first support slope 211*b*, can be arranged on the second support slope 211*c*, or also can be arranged on the support plane 211*a*. Alternatively, the block portion 211*d* can be arranged on each of the support plane 211*a*, the first support slope 211*b* and the second support slope 211*c*.

Fourth Embodiment

The embodiment is based on the above mentioned embodiment to optimize the ground railway transfer device.

The function of the above mentioned guide rail 22 is to apply a driving force to the two half-frames so that the two half-frames move toward each other to reduce the distance between the wheels.

The guide rail 22 includes: two guide bodies 221 with a same structure which are symmetrically distributed on both sides of the transition plate 23. Each of the guide bodies 221 is provided with a guide structure, to provide a railway transfer driving force to a railway transfer guide member arranged on the bogie.

The guide body 211 can be implemented in a variety of manners. For example: The guide body 221 can be parallel to the first railway 11. The guide structure may be hydraulic or pneumatic. The guide structure pushes the half-frame to move in the transverse direction when the bogie enters the railway transfer area.

Alternatively, the guide rail 22 can adopt the following manner provided by the embodiment. As shown in FIG. 1, the guide structure is a guide groove 222 for accommodating the railway transfer guide member. The guide groove 222 has an upward opening, and has a side wall in contact with the railway transfer guide member to provide the railway transfer driving force to the railway transfer guide member.

The railway transfer guide member is a structure arranged on the half-frame. When the bogie enters the railway transfer area, the railway transfer guide member is inserted downward into the guide groove 222. The center line of the guide groove 222 is at a set angle to the longitudinal direction. For example, as shown in FIG. 1, a distance between ends of the two guide bodies 221 facing toward the first railway 11 is greater than a distance between ends of the two guide bodies facing toward the second railway 12. As the bogie moves forward, side walls of the guide grooves 222 exert thrust on railway transfer guide members, thereby pushing the half-frames to move toward or away from each other.

The transfer from wide gauge railway to narrow gauge railway is taken as an example. The bogie travels in a direction from the first railway 11 to the second railway 12, and the railway transfer guide member enters the guide groove 222 after the wheels at the front in the traveling direction leave the first railway 11. The guide grooves 222 on both sides have a tendency to retract inward, and the two half-frames are pushed to move toward each other by the railway transfer guide members. The two half-frames move in place when the railway transfer guides are disengaged from the guide grooves 222.

Further, ends of the two side walls of the guide groove 222 are provided with second guide slopes 223 for guiding the railway transfer guide member that will enter the guide groove 222, to allow the railway transfer guide member to enter the guide groove 222 more smoothly. The longitudinal length of the second guide slope 223 is 150 mm.

The center line of the guide groove 222 shown in FIG. 1 is a straight line. The center line of the guide groove 222 can also be a polyline, an arc line segment or other irregular line segments, as long as the distance between two ends of the center line and two ends of a center line of another guide groove 222 can meet the requirement for the first gauge and the second gauge.

If the difference in the transverse distances between the two ends of the center line of the guide groove 222 and the extension line of the center line of the first rail 11 is equal to one half of the difference between the first gauge and the second gauge, the requirement for the first gauge and the second gauge can be met.

Figure 3:
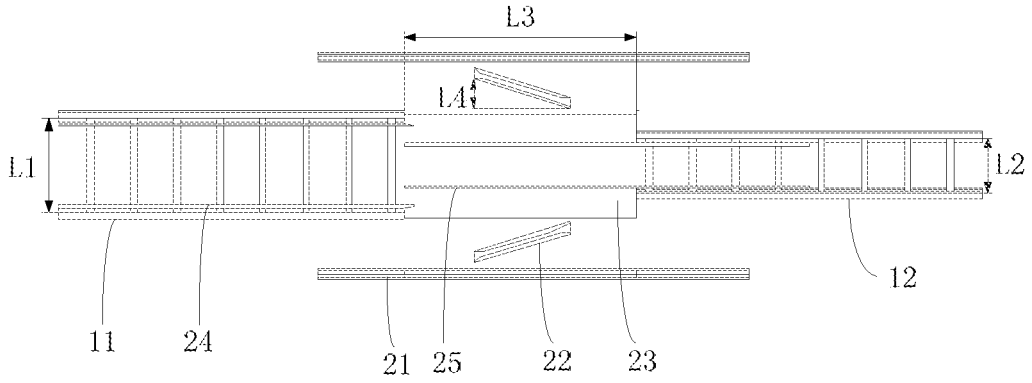
FIG. 3 is a top view of a ground railway transfer device provided by a fourth embodiment of the disclosure.

FIG. 3 is a top view of the ground railway transfer device provided by the fourth embodiment of the disclosure. As shown in FIG. 3, a width of the first railway 11 is a first gauge L1, and a width of the second railway 12 is a second gauge L2. A distance between an end of the first railway 11 and an end of the second railway 12 (that is, the length of the transition plate 23) is L3, a length of the support plane 211*a* of the support rail 21 is greater than L3. A transverse distance L4 between a left end and a right end of the guide rail 22 is one half of the difference between the first gauge L1 and the second gauge L2. A depth of the guide groove 222 can be arranged according to the size of the railway transfer guide member, so that at least half of the railway transfer guide member is inserted into the guide groove 222.

In addition, the transfer from the first railway 11 to the second railway 12 is taken as an example. For the bogie traveling forward, a wheel at the front is called a front wheel, and a wheel at the rear is called a rear wheel. The rear wheel just leaves the first railway 11 before the railway transfer guide member enters the guide groove 222 of the guide rail 22; and the front wheel just enters the second railway 12 when the railway transfer guide member leaves the guide groove 222. Thus, the length L3 of the transition plate 23 can be set to be greater than a sum of an axle distance of the bogie (that is, a sum of a distance between the railway transfer guide member and a center of a front axle, and a distance between the railway transfer guide member and a center of a rear axle), a length of the railway transfer guide member, and a length of the guide rail 22 in a longitudinal direction. For example, the axle distance of the bogie is 1.6 m, the length of the railway transfer guide member is 150 mm, and the length of the guide rail 22 in the longitudinal direction is 1 m, then the length of the transition plate 23 is L3=(1.6+0.15+1)m=2.75 m, or L3 can also be slightly larger than 2.75 m.

Figure 4:
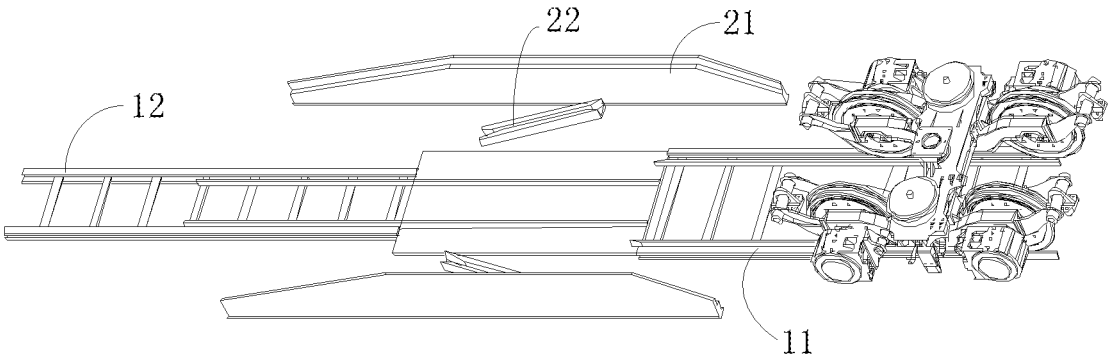
FIGS. 4 to 6 are schematic views of a process of railway transfer of a bogie by the ground railway transfer device provided in the fourth embodiment of the disclosure.
Figure 5:
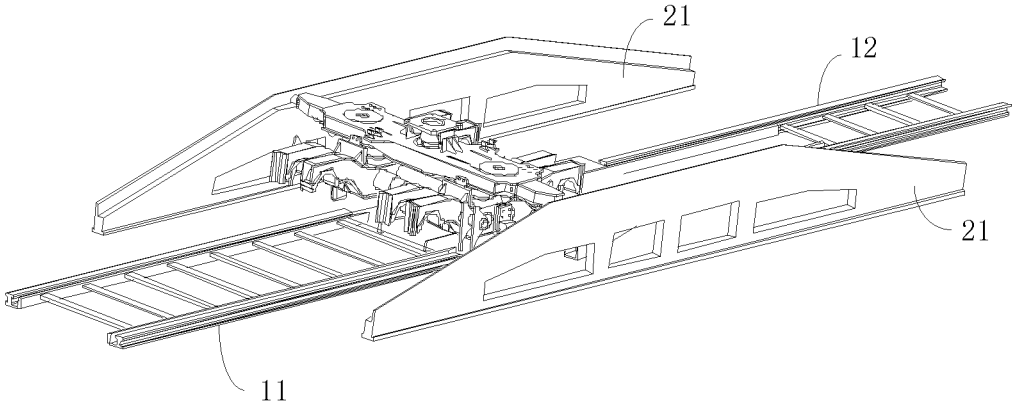
Figure 6:
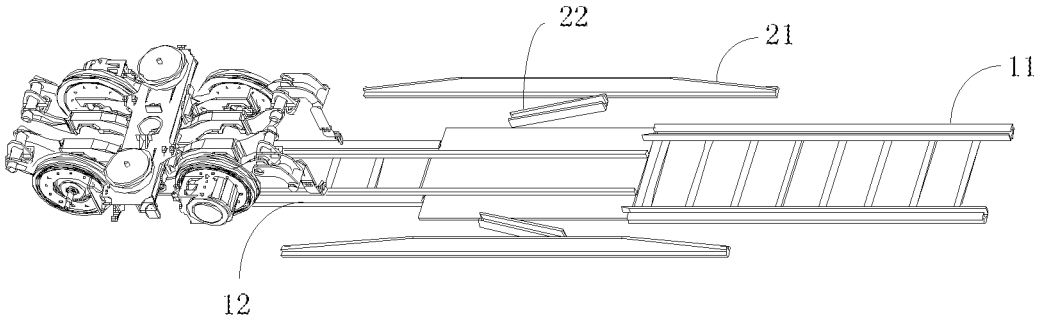

FIGS. 4 to 6 are schematic views of the process of railway transfer of the bogie by the ground railway transfer device provided by the fourth embodiment of the disclosure. The transfer from the first railway 11 with a wide gauge to the second railway 12 with a narrow gauge is taken as an example. FIG. 4 shows that the bogie is moving towards the left on the first railway 11 before the railway transfer. The railway transfer support members on both sides of the bogie bolster are unfolded to engage with the support rail 21 when the bogie approaches the support rail 21. As the bogie continues to move forward, the bolster is gradually raised under the guiding effect of first support slopes 211*b* of the support rail 21, to unload the vertical loads of the half-frames, but retain the traction force, as shown in FIG. 5. The railway transfer guide members on the half-frames are inserted into the guide rail 22, an then the thrust is applied to the half-frames under the action of guide rail 22, in order to move two half-frames toward each other into a gauge that matches the second railway 12. When the half-frames are moved in place, the bolster will gradually descend under the guiding effect of the second support slopes 211*c*, and the vertical loads of the half-frames are reloaded to complete the railway transfer. FIG. 6 shows that the bogie is moving into the second railway 12.

In FIG. 5, the wheels and other components have been removed, in order to facilitate a clear display of the structure related to the railway transfer.

Fifth Embodiment

The embodiment is based on the above mentioned embodiment, and provides a specific implementation manner of railway transfer support members.

Figure 7:
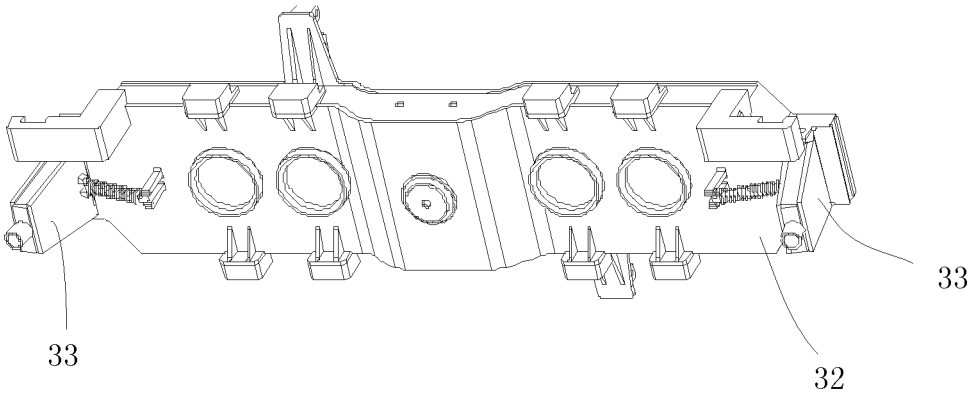
FIG. 7 is a schematic view of a structure of a bolster in a bogie provided by a fifth embodiment of the disclosure.
Figure 8:
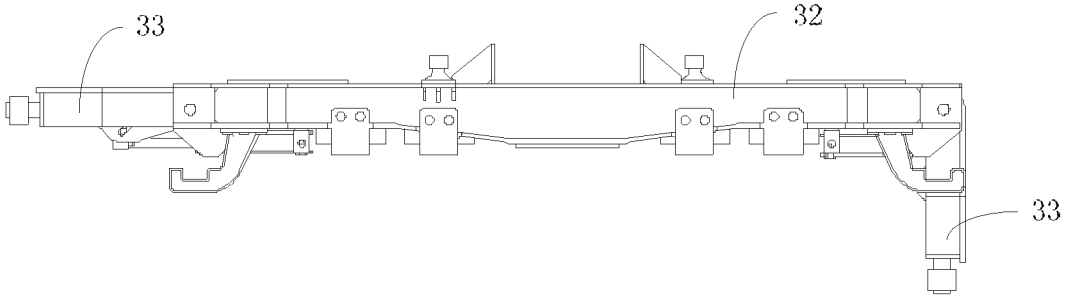
FIG. 8 is a front view of the bolster provided by the fifth embodiment.
Figure 9:
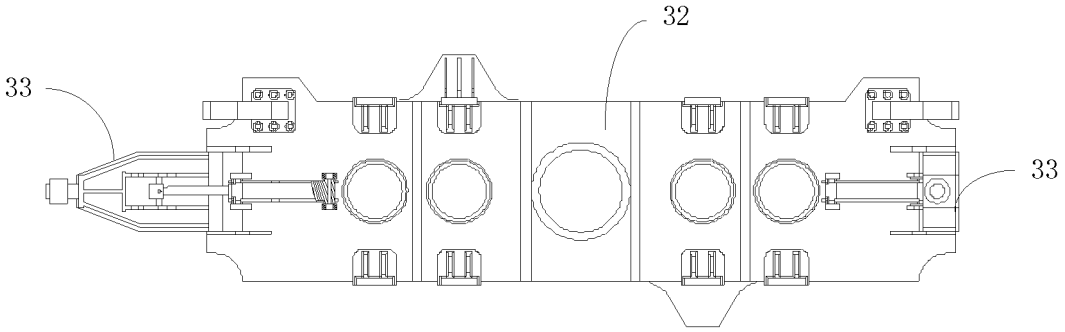
FIG. 9 is a bottom view of the bolster shown in FIG. 8.

FIG. 7 is a schematic view of the structure of a bolster in the bogie provided by the fifth embodiment of the disclosure, FIG. 8 is a front view of the bolster provided by the fifth embodiment of the disclosure, and FIG. 9 is a bottom view of the bolster shown in FIG.8. As shown in FIG. 7 to FIG. 9, railway transfer support members 33 are arranged at both ends of the bolster 32, and the railway transfer support members 33 can be unfolded relative to the bolster 32 or folded downward. FIG. 7 shows that each of the railway transfer support members 33 at both ends of the bolster is folded down, and FIGS. 8 and 9 show that the railway transfer support member 33 at one end of the bolster is folded down, and the railway transfer support member 33 at the other end of the bolster is in an unfolded state.

Figure 10:
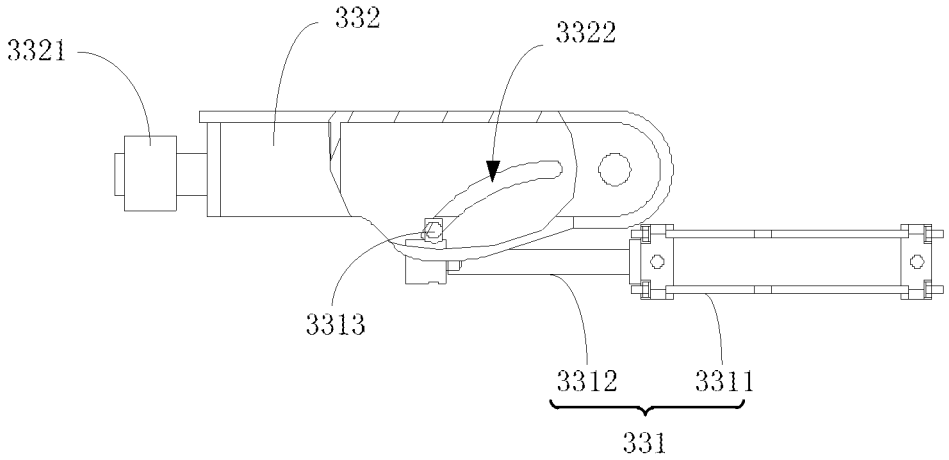
FIG. 10 is a partial section view of a railway transfer support member in an unfolded state provided by the fifth embodiment of the disclosure.
Figure 11:
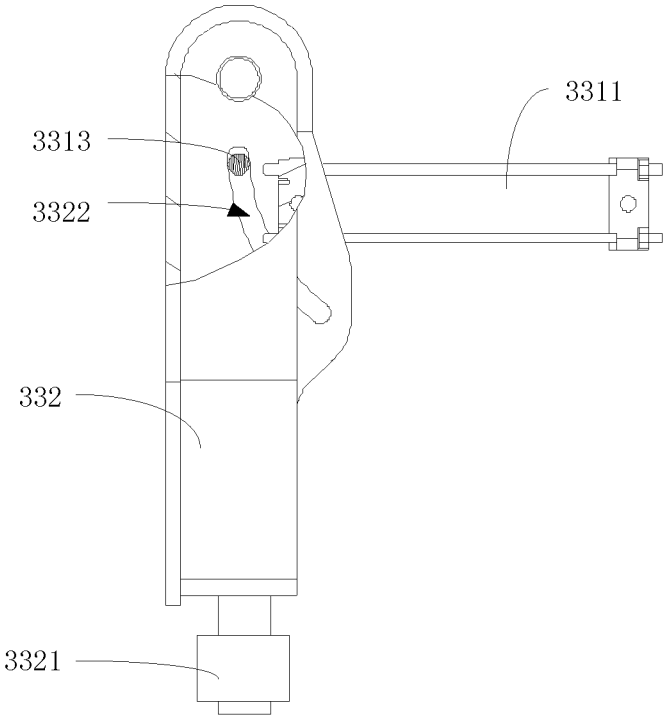
FIG. 11 is a partial section view of the railway transfer support member in a folded state provided by the fifth embodiment of the disclosure.
Figure 12:
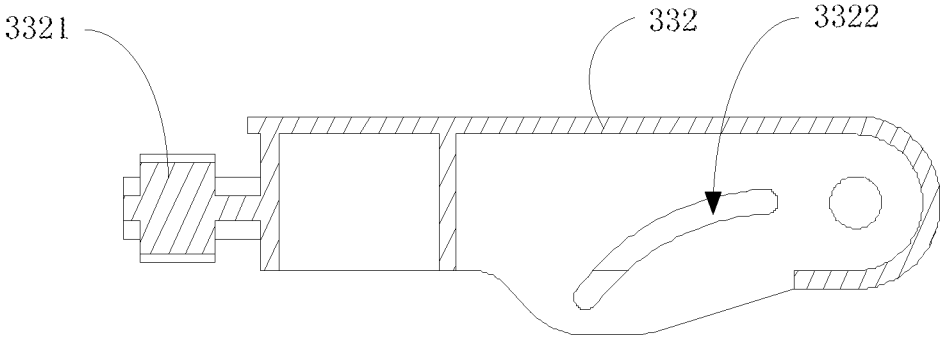
FIG. 12 is a section view of a driven member in the railway transfer support member provided by the fifth embodiment of the disclosure.
Figure 13:
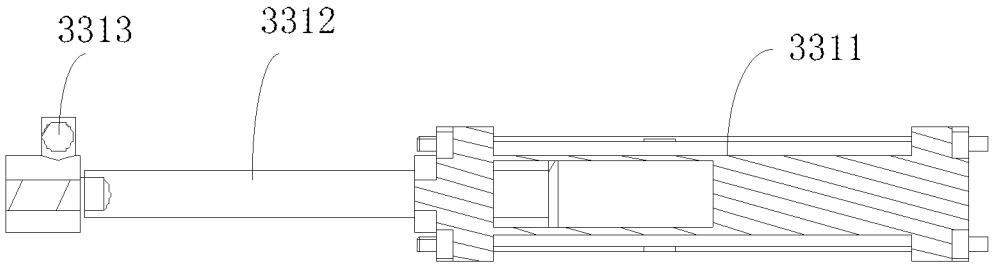
FIG. 13 is a section view of a driving member in the railway transfer support member provided by the fifth embodiment of the disclosure.

FIG. 10 is a partial section view of the railway transfer support member provided by the fifth embodiment of the disclosure in an unfolded state, FIG. 11 is a partial section view of the railway transfer support member provided by the fifth embodiment of the disclosure in a folded state, FIG. 12 is a section view of a driven member in the railway transfer support member provided by the fifth embodiment of the disclosure, and FIG. 13 is a section view of a driving member in the railway transfer support member provided by the fifth embodiment of the disclosure.

The railway transfer support member 33 includes: the driving member 331 and the driven member 332. One end of the driving member 331 is fixed on the bolster 32, and another end of the driving member is connected to the middle of the driven member 332. An end of the driven member 332 is hinged to the bolster 32. The driving member 331 can apply a thrust or a pulling force on the middle of the driven member 332 so that the driven member 332 can rotate relative to the bolster 32.

As shown in FIGS. 10 to 13, the driving member 331 may include a cylinder 3311 and a piston rod 3312 provided with a piston at an end and telescopically inserted into the cylinder 3311, and a slider 3313 is arranged at an end of the piston rod 3312. The piston rod 3312 telescopically moves in the transverse direction. One end of the driven member 332 is hinged with an end of the bolster 32, and another end of the driven member is provided with a roller 3321 which can roll on the support rail 21. A sliding groove 3322 is arranged in the middle of the driven member 332, and the slider 3313 is slidably arranged in the sliding groove 3322.

The working process of the above mentioned railway transfer support member is as follow.

Working fluid is injected into the cylinder 3311 to push the piston rod 3312 to move outward when the railway transfer operation is required. By the cooperation of the slider 3313 with the sliding groove 3322, the driven member rotates relative to the bolster 32, such that the driven member turns upward to be substantially parallel to the bolster, and then roller 3321 can be engaged with the support rail 21.

After the railway transfer is completed, the working fluid in the cylinder 3311 is discharged, to pull the piston rod 3312 to retract inward. By the cooperation of the slider 3313 with the sliding groove 3322, the driven member rotates relative to the bolster 32, such that the driven member turns downward and is folded.

Sixth Embodiment

The embodiment is based on the above mentioned embodiment, and provides a specific implementation manner of the bogie.

Figure 14:
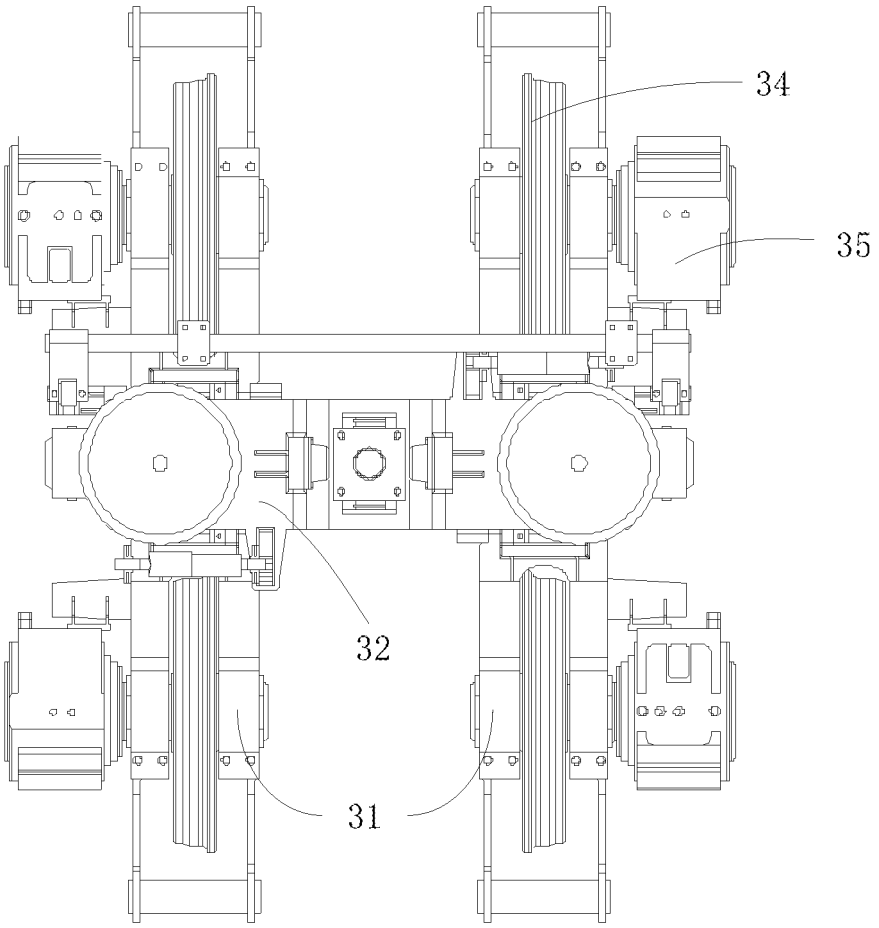
FIG. 14 is a top view of a bogie provided by a sixth embodiment of the disclosure.
Figure 15:
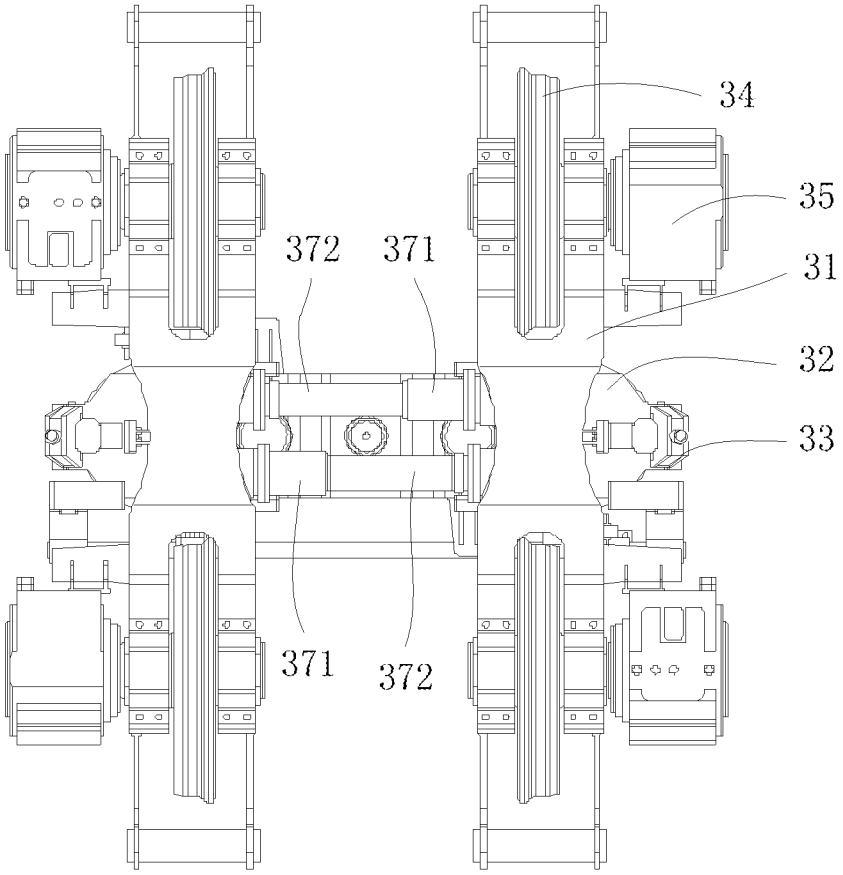
FIG. 15 is a bottom view of the bogie provided by the sixth embodiment of the disclosure.
Figure 16:
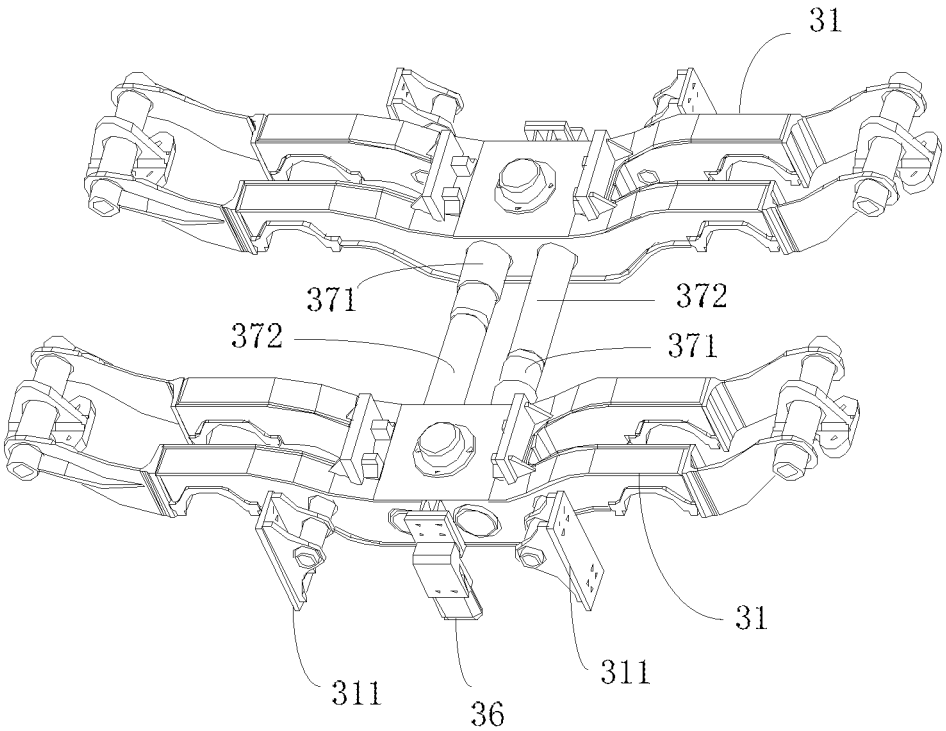
FIG. 16 is a schematic view of the structure of two half-frames in the bogie provided by the sixth embodiment of the disclosure in a wide gauge.
Figure 17:
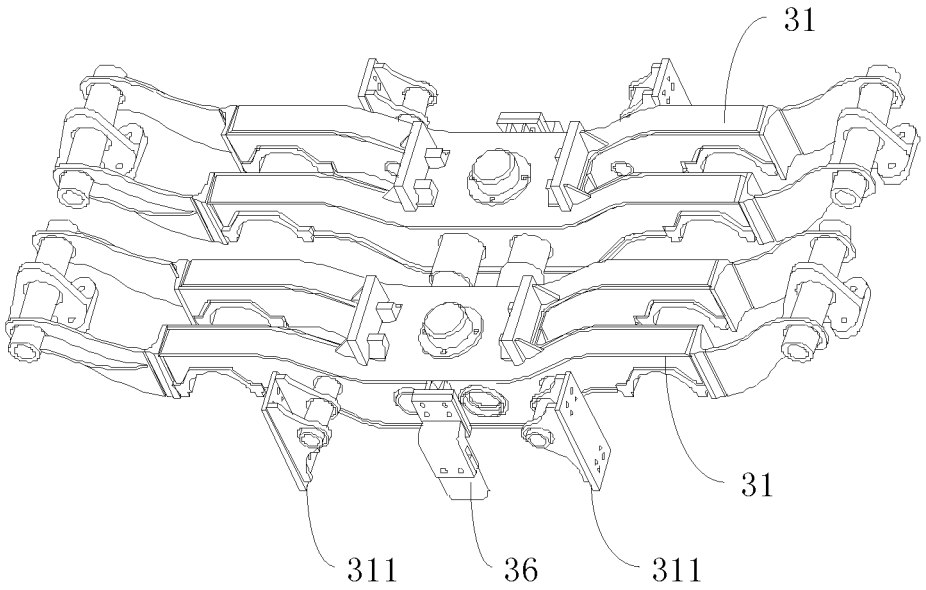
FIG. 17 is a schematic view of the structure of the two half-frames in the bogie provided by the sixth embodiment of the disclosure in a narrow gauge.

FIG. 14 is a top view of a bogie provided by the sixth embodiment of the disclosure, FIG. 15 is a bottom view of the bogie provided by the sixth embodiment of the disclosure, FIG. 16 is a schematic view of the structure of two half-frames in the bogie provided by the sixth embodiment of the disclosure in a wide gauge, and FIG. 17 is a schematic view of the structure of the two half-frames in the bogie provided by the sixth embodiment of the disclosure in a narrow gauge. As shown in FIGS. 14 to 17, taking a power bogie as an example, the bogie includes: two half-frames 31 arranged in parallel and a bolster 32 extending across the two half-frames 31. Two wheel pairs are arranged between the two half-frames 31, and each wheel pair includes an axle and two wheels 34 symmetrically arranged on the axle. A railway transfer guide member 36 is arranged on the outer side of the half-frame 31 for cooperating with the guide rail 22 to realize the railway transfer.

For the power bogie, the half-frame is further provided with a motor hanger 311 for installing the traction motor 35. For a non-powered bogie, there is no need to provide the traction motor 35, and accordingly there is no need to provide a motor hanger 311.

Insertable connectors are arranged between the two half-frames 31. For example, a first insertable connector 371 and a second insertable connector 372 are arranged side by side on one of the two half-frames 31, and a second insertable connector 372 and a first insertable connector 371 are arranged side by side on the other one of the two half-frame 31. The second insertable connector 372 on one half-frame 31 is correspondingly inserted into the first insertable connector 371 on the other half-frame 31, and the second insertable connector 372 can stretch out and contract with respect to the first insertable connector 371 in the transverse direction.

The distance between the two half-frames 31 is reduced to adapt the railway with the narrow gauge, when the second insertable connector 372 is inserted into the first insertable connector 371. The distance between the two half-frames 31 is increased to adapt the railway with the wide gauge, when the second insertable connector 372 protrudes partly from the first insertable connector 371.

FIGS. 18 to 21 are schematic views of railway transfer carried out by cooperation of the bogie with the ground railway transfer device provided by the sixth embodiment of the disclosure. Based on the above technical solution, the process of the railway transfer carried out by cooperation of the bogie with the ground railway transfer device is described as follows.

Figure 18:
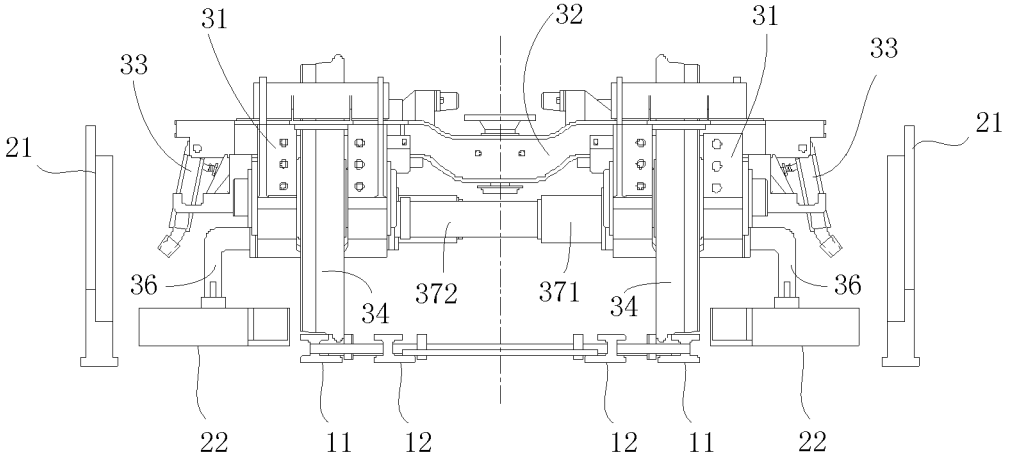
FIGS. 18 to 21 are schematic views of railway transfer carried out by a cooperation of a bogie with a ground railway transfer device provided by a seventh embodiment of the disclosure.

As shown in FIG. 18, the wheels 34 of the bogie travel on the first railway 11, and the railway transfer support members 33 hang downward. The second insertable connectors 372 are in a position in which the second insertable connectors 372 maximally stretch out from the first insertable connectors 371.

Figure 19:
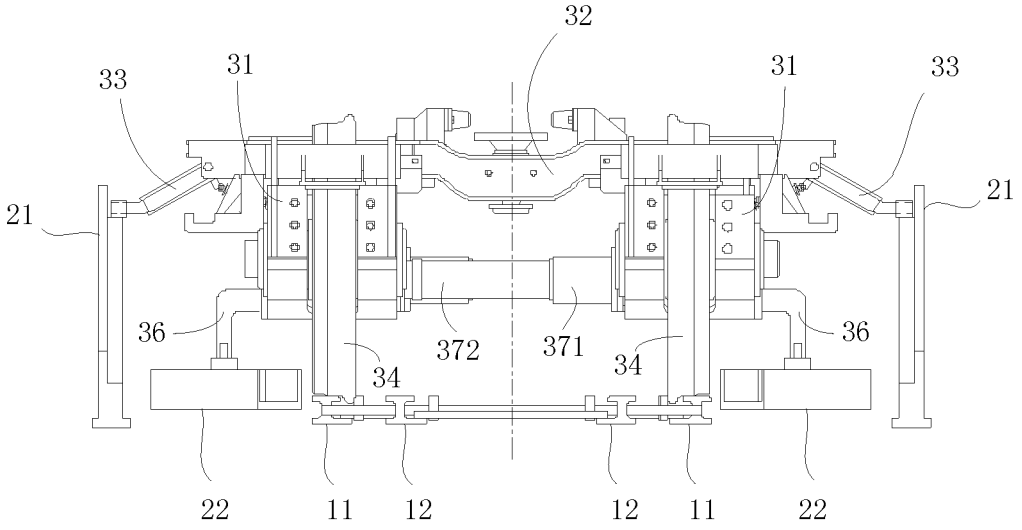

As shown in FIG. 19, the bogie travels towards the direction of the second railway 12 and the railway transfer supports 33 are unfolded to engage with the support rail 21. The support rail 21 supports the bolster 32 and raises the level of the bolster 32 to unload the vertical loads of the half-frames 31. The railway transfer guide members 36 are inserted into the guide rail 22, and the guide rail 22 pushes the two half-frames 31 to move toward each other by applying a thrust to the railway transfer guide members 36.

Figure 20:
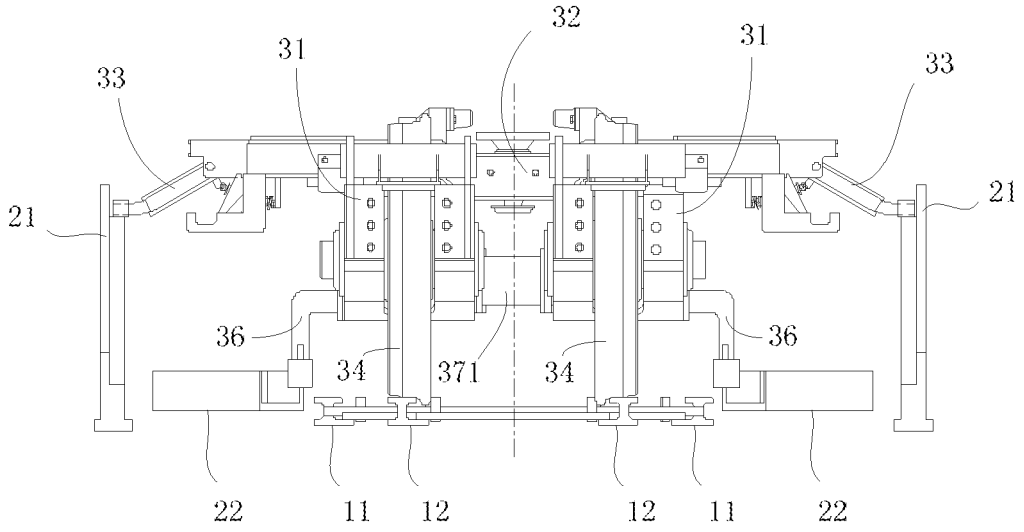

As shown in FIG. 20, the two half-frames 31 move in place and the second insertable connectors 372 are completely inserted into the first insertable connectors 371. The railway transfer guide members 36 are separated from the guide rail 22.

Figure 21:
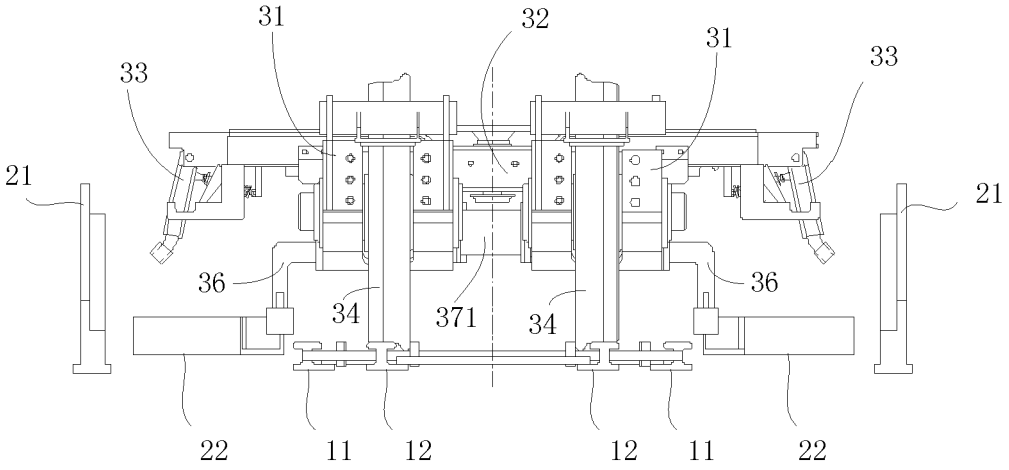

As shown in FIG. 21, the bolster 32 is gradually lowered along the support rail 21, and the vertical loads are reloaded on the half-frames 31. The railway transfer support members 33 are turned downward into a hanging state. The wheels travel on the second railway 12 thereby completing the rail transfer.

The traveling process of the bogie from the second railway 12 to the first railway 11 is similar to the above process, except that the guide rail 22 generates a pulling force on the half-frames 31, so that the two half-frames 31 move away from each other towards two sides to adapt to the first railway 11 with a wider gauge.

Seventh Embodiment

The embodiment provides a gauge changing system which includes: a gauge changing bogie and a ground railway transfer device provided in any one of the above embodiments.

FIGS. 18 to 21 are schematic views of the railway transfer carried out by cooperation of the bogie with the ground railway transfer device provided by the seventh embodiment of the disclosure. Based on the above technical solution, a process of the railway transfer carried out by cooperation of the bogie with the ground railway transfer device is described as follows.

As shown in FIG. 18, the wheels 34 of the bogie travel on the first rail 11, and the rail transfer support members 33 hang downward. The second insertable connectors 372 are in a position in which the second insertable connectors 372 maximally stretch out from the first insertable connectors 371.

As shown in FIG. 19, the bogie travels towards the direction of the second railway 12 and the railway transfer supports 33 are unfolded to engage with the support rail 21. The support rail 21 supports the bolster 32 and raises the level of the bolster 32 to unload the vertical loads of the half-frames 31. The railway transfer guide members 36 are inserted into the guide rail 22, and the guide rail 22 pushes the two half-frames 31 to move toward each other by applying a thrust to the rail transfer guide members 36.

As shown in FIG. 20, the two half-frames 31 move in place and the second insertable connectors 372 are completely inserted into the first insertable connectors 371. The railway transfer guide members 36 are separated from the guide rail 22.

As shown in FIG. 21, the bolster 32 is gradually lowered along the support rail 21, and the vertical loads are reloaded on the half-frames 31. The rail transfer support members 33 are turned downward to a hanging state. The wheels travel on the second railway 12, thereby completing the railway transfer.

The support rail arranged on the ground can be used to unload the vertical load of the bogie in the railway vehicle, and the guide rail arranged on the ground can be used to drive the bogie to perform the railway transfer operation, so that the bogie can switch between the first gauge and the second gauge. The transition plate arranged on the ground and located between the first railway and the second railway can also be used. The difference in a height direction between the top surface of the transition plate and the top surface of the first railway is equal to the distance between the wheel rim tip circle and the wheel tread of the railway vehicle. The transition plate therefore supports wheels after the wheels leave the first railway or the second railway, in which the heights of the wheels do not change, so that the wheels will not fall down and thus large vibration can be avoided.

In the description of the disclosure, it should be understood that, the orientation or positional relationship indicated by the terms such as "center", "longitudinal", "transverse", "length", "width", "thickness", "up", "down", "front", "rear", "left", "right", "vertical", "horizontal", "top", "bottom", "inside" and "outside" is based on the orientation or positional relationship shown in the drawings. It is intended only for the convenience of describing the disclosure and simplifying the description, rather than indicating or implying that the device or element referred to must have a specific orientation, be constructed and operated in a specific orientation, and therefore cannot be understood as a limitation of the disclosure.

In addition, the terms "first" and "second" are only used for descriptive purposes, and cannot be understood as indicating or implying relative importance or implicitly indicating the number of indicated technical features. Thus, the feature defined with "first" or "second" may include explicitly or implicitly one feature or a plurality of the features. In the description of the disclosure, "a plurality of" means at least two, such as two, three or more, unless specifically defined otherwise.

In the disclosure, unless otherwise clearly specified and limited, the terms "install", "link", "connect", "fix" and other terms should be interpreted broadly. For example, it may be a fixed connection, a detachable connection, or an integrated connection; it may be a mechanical connection or an electrical connection or a mutual communication; it may be a direct connection, or an indirect connection by an intermediate medium; and it may also be a communication between two elements or an interaction relationship between two elements. For those of ordinary skill in the art, the specific meanings of the above mentioned terms in the disclosure can be understood according to specific circumstances.

Although the preferred embodiments of the disclosure have been described, those skilled in the art can make additional changes and modifications to these embodiments once they learn the basic creative concept. Therefore, the claims are intended to be interpreted as including the preferred embodiments and all changes and modifications within the scope of this disclosure.

Obviously, those skilled in the art can make various changes and modifications to the disclosure without departing from the spirit and scope of the disclosure. In this way, if these modifications and variations of the disclosure fall into the scope of the claims of the disclosure and their equivalent technologies, then the disclosure is also intended to include these modifications and variations.

What is claimed is:

1. A ground railway transfer device for driving a railway vehicle to switch between a first railway and a second railway, the first railway having a gauge called as a first gauge, the second railway having a gauge called as a second gauge, the first gauge being different from the second gauge; the first railway and the second railway extending in a longitudinal direction, wherein the ground railway transfer device comprises:

a support rail arranged on the ground and configured for unloading a vertical load of a bogie in the railway vehicle;

a guide rail arranged on the ground and configured for driving the bogie to perform a railway transfer operation, such that the bogie switches between the first gauge and the second gauge;

a transition plate arranged on the ground and located in the longitudinal direction between the first railway and the second railway, a difference in a height direction between a top surface of the transition plate and a top surface of the first railway being equal to a distance between a wheel rim tip circle and a wheel tread of the railway vehicle, wherein the guide rail comprises: two guide bodies with a same structure, the two guide bodies being symmetrically distributed on both sides of the transition plate;

each of the guide bodies is provided with a guide structure, the guide structure is a guide groove for accommodating a railway transfer guide member arranged on the bogie, a side wall of the guide groove being in contact with the railway transfer guide member to provide the railway transfer driving force to the railway transfer guide member; and wherein a center line of the guide groove is at a set angle to the longitudinal direction; a difference in the transverse distances between two ends of the center line of the guide groove and an extension line of a center line of the first rail is equal to one half of a difference between the first gauge and the second gauge.

2. The ground railway transfer device according to claim 1, further comprising:

a first guide member arranged inside the first railway and configured for guiding wheels traveling to the first railway.

3. The ground railway transfer device according to claim 2, wherein the first guide member is parallel to the first railway and is spaced from the first railway by a gap, an end of the first guide member facing toward the second railway protruding beyond the first railway, and a surface of the end facing toward the first railway being provided with a first guide slope.

4. The ground railway transfer device according to claim 1, further comprising:

a second guide member arranged inside the second railway and configured for guiding wheels traveling to the second railway.

5. The ground railway transfer device according to claim 4, wherein the second guide member is parallel to the second railway and is spaced from the second railway by a gap, an end of the second guide member facing toward the first railway protruding beyond the second railway.

6. The ground railway transfer device according to claim 5, wherein an end of the second guide member facing toward the first railway extends to the first railway.

7. The ground railway transfer device according to claim 1, wherein the support rail comprises two support bodies with a same structure, the two support bodies being symmetrically distributed on both sides of the transition plate; and each of the support bodies is provided with a support structure, for supporting a bolster in the bogie and raising a level of the bolster.

8. The ground railway transfer device according to claim 7, wherein the support structure is a support plane arranged on the top of the support body and support slopes located at both ends of the support plane, heights of the support slopes gradually decreasing from the middle of the support body to two ends of the support body.

9. The ground railway transfer device according to claim 8, wherein a length of the support plane is greater than a length of the transition plate; and the support plane has overlapping parts that overlap with the first railway and the second railway.

10. The ground railway transfer device according to claim 8, wherein a block portion is arranged on a side of the support body away from the transition plate and at the top of the support body, and the block portion being higher than the support plane.

11. The ground railway transfer device according to claim 7, wherein railway transfer support members are arranged at both ends of the bolster, and the railway transfer support members are unfolded relative to the bolster or folded downward.

12. The ground railway transfer device according to claim 11, wherein each of the railway transfer support members comprises: a driving member and a driven member, one end of the driving member is fixed on the bolster, and another end of the driving member is connected to the middle of the driven member, and an end of the driven member is hinged to the bolster.

13. The ground railway transfer device according to claim 1, wherein a length of the transition plate is greater than or equal to a sum of an axle distance of the bogie, a length of the railway transfer guide member and a length of the guide rail in a longitudinal direction.

14. The ground railway transfer device according to claim 1, wherein side walls at both ends of the guide groove are provided with second guide slopes.

15. A gauge changing system comprising:

a gauge changing bogie; and a ground railway transfer device for driving a railway vehicle to switch between a first railway and a second railway, the first railway having a gauge called as a first gauge, the second railway having a gauge called as a second gauge, the first gauge being different from the second gauge; the first railway and the second railway extending in a longitudinal direction, wherein the ground railway transfer device comprises:

a support rail arranged on the ground and configured for unloading a vertical load of a bogie in the railway vehicle;

a guide rail arranged on the ground and configured for driving the bogie to perform a railway transfer operation, so that the bogie switches between the first gauge and the second gauge;

a transition plate arranged on the ground and located in the longitudinal direction between the first railway and the second railway, a difference in a height direction between a top surface of the transition plate and a top surface of the first railway being equal to a distance between a wheel rim tip circle and a wheel tread of the railway vehicle, wherein the guide rail comprises:

two guide bodies with a same structure, the two guide bodies being symmetrically distributed on both sides of the transition plate;

each of the guide bodies is provided with a guide structure, the guide structure is a guide groove for accommodating a railway transfer guide member arranged on the bogie, a side wall of the guide groove being in contact with the railway transfer guide member to provide the railway transfer driving force to the railway transfer guide member; and wherein a center line of the guide groove is at a set angle to the longitudinal direction; a difference in the transverse distances between two ends of the center line of the guide groove and an extension line of a center line of the first rail is equal to one half of a difference between the first gauge and the second gauge.

16. The ground railway transfer device according to claim 2, further comprising:

a second guide member arranged inside the second railway and configured for guiding wheels traveling to the second railway.

17. The ground railway transfer device according to claim 1, wherein a rear wheel just leaves the first railway before the railway transfer guide member enters the guide groove of the guide rail; and a front wheel just enters the second railway when the railway transfer guide member leaves the guide groove.

* * * * *